US010124339B2

(12) United States Patent
Lewis et al.

(10) Patent No.: US 10,124,339 B2
(45) Date of Patent: Nov. 13, 2018

(54) ACCURATE VOLUME FLUID COLLECTION CARD SYSTEM

(71) Applicant: OpAns, LLC, Durham, NC (US)

(72) Inventors: Kenneth Cranford Lewis, Cary, NC (US); Tina Carol Guilliams Baxter, Cary, NC (US)

(73) Assignee: OpAns LLC, Durham, NC (US)

( * ) Notice: Subject to any disclaimer, the term of this patent is extended or adjusted under 35 U.S.C. 154(b) by 60 days.

(21) Appl. No.: 15/008,745

(22) Filed: Jan. 28, 2016

(65) Prior Publication Data

US 2016/0220992 A1 Aug. 4, 2016

Related U.S. Application Data

(60) Provisional application No. 62/109,152, filed on Jan. 29, 2015.

(51) Int. Cl.
*B01L 3/00* (2006.01)

(52) U.S. Cl.
CPC ..... *B01L 3/5055* (2013.01); *B01L 2300/041* (2013.01); *B01L 2300/069* (2013.01); *B01L 2300/0887* (2013.01)

(58) Field of Classification Search
CPC ..... B01L 3/50; B01L 3/505; B01L 3/5023; B01L 2300/0887; B01L 2300/041; B01L 2300/069; B01L 2300/168; B01L 2300/0816
See application file for complete search history.

(56) References Cited

U.S. PATENT DOCUMENTS 3,990,850 A * 11/1976 Friedman ..... G01N 33/54386 422/401
4,225,557 A 9/1980 Hartl et al.
4,789,629 A 12/1988 Baker et al.
2002/0062114 A1* 5/2002 Murai ..... A61F 13/42 604/385.01
2003/0170143 A1* 9/2003 Cunningham ..... B01L 3/5085 422/400

FOREIGN PATENT DOCUMENTS

EP 0717283 A2 * 6/1996 ..... B01L 3/545

OTHER PUBLICATIONS

Protein Saver Snap Apart. Retrieved Oct. 6, 2016. http://www.gelifesciences.com/webapp/wcs/stores/servlet/catalog/en/GELifeSciences-us/products/AlternativeProductStructure_21577/28416622.

* cited by examiner

*Primary Examiner* — Christopher Adam Hixson
(74) *Attorney, Agent, or Firm* — Brinks Gilson & Lione

(57) ABSTRACT

A composite collection device suitable for the collection of fluid samples is disclosed. The device is suitable for the collection of a multitude of fluid samples, including biological fluids like blood, urine, saliva, plasma specimens for subsequent determination of analytes contained therein. An accurate volume fluid collection card system with a single or multiplicity of cells comprises three strata, a middle absorbent stratum, layered between an impermeable cover stratum containing at least one aperture and a transparent stratum containing indicia. The aperture in the impermeable cover stratum directs the fluid onto the middle absorbent. The middle absorbent stratum contains no alterations. The transparent stratum contains indicia that indicate the extent of the absorption of the fluid.

14 Claims, 20 Drawing Sheets

ACCURATE VOLUME FLUID COLLECTION CARD SYSTEM

This application claims the benefit of U.S. Provisional Application No. 62/109,152, filed Jan. 29, 2015, the entire contents of which are hereby incorporated by reference.

BACKGROUND

For nearly 100 years, fluid collection cards containing a solid phase matrix for the collection and subsequent analysis of a dried specimen matrix have been used as a scientific tool. For example in the early 1960s, Dr. Robert Guthrie used filter paper to collect dried blood spot specimens to measure phenylalanine in newborns for the detection of phenylketonuria (Guthrie and Susi 1963). This application for collecting blood led to widespread screening of newborns for the detection of treatable, inherited metabolic diseases. Typically, a patient's fingertip is punctured and the card is impregnated with blood from the puncture site. The blood is allowed to dry and the card is then sent to a testing laboratory. At the testing laboratory, a portion of the card impregnated with blood is separated, such as cut out or punched out, producing a coupon from which the blood is eluted. The eluted blood may then be analyzed for compounds contained within the blood specimen.

Presently, a wide variety of fluid collection cards are available for purchase. Conventional collection cards typically consist of a single layer filter paper containing printed indicia on one side. Like most standard scientific devices, card devices typically have an associated imprecision. The imprecision associated with conventional collection cards may be related to many factors, including:

a. the filter paper's consistency and quality,
b. unknown changes that may have occurred to the filter paper,
c. lack of proper spotting technique; and
d. the addition of printed indicia,
e. specimen contamination or damage during handling, processing, or transportation.

Conventional fluid collection cards typically contain a standardized filter paper made from high purity cotton linters, and manufactured to maximize the accuracy and precision with which specimens are absorbed. If used properly, the card devices may provide an acceptable level of accuracy and precision for a given application, for example like those that analytical scientists and clinicians have come to expect from standard methods of collecting blood, such as capillary pipettes.

Because a large surface is exposed on the sample collection area, conventional fluid collection cards are easily contaminated by the user, for example, contact with hands or some other surface prior to sample collection often introduces hand lotions alcohol, body oils, or DNA contamination. This contamination may interfere with the proper absorption of the fluid into the filter paper and therefore may interfere with the accuracy of the volume or content of the sample collected.

The manufacturers of the available card devices emphasize the importance of proper spotting technique, or proper specimen collection technique, and the consequent impact on specimen quality. For example, if the patient's finger touches or is smeared across the absorbent material of the collection card, the full volume of the material is not filled with specimen (i.e., the volume of the absorbent material through to the back of the material is not filled); therefore, when punched, results in a coupon with an inaccurate volume of specimen and consequently an inaccurate analytical result (i.e., concentration of analyte in specimen). In order to obtain an accurate volume specimen, ensuring the filter paper is filled thoroughly to the back of the paper without over filling and not on the surface alone is essential. With the conventional fluid collection cards, however, the imprecision introduced as a result of mishandling by the user, is difficult to control.

In conventional collection cards, indicia have been printed upon the exposed surface of the card, which indicated where on the card to apply the fluid specimen. These printed indicia may interfere with the uniformity of absorption of the specimen into the paper material. The ink or pressure applied during printing can change the density of the material and may cause the specimen to slow or hasten during the spreading processes which will lead to an inconsistent final volume of specimen per coupon.

Because the specimen is contained on an exposed surface, it may become contaminated or otherwise damaged during handling or transport. To overcome this problem improved collection cards comprise a protective housing. For example, collection cards used in the HIV and Hepatitis C Home Test Systems available from the Home Access Health Corporation of 2401 West Hassell Road, Suite 1510 Hoffman Estates, Ill. 60169, and sold under the trademark HOME ACCESS, comprise a matchbook type housing. Similar housing is commonly used to transport biological specimens as disclosed in U.S. Pat. No. 4,225,557 to Hartl et al. and U.S. Pat. No. 4,789,629 to Baker et al. Although, the use of such packing increases production costs it provides needed functionality.

The use of fluid collection cards still has many advantages including, ease of collection, transport, and storage, making them a cost-effective choice for certain applications.

BRIEF SUMMARY OF THE INVENTION

One embodiment of the present invention provides an improved fluid collection card system. One aspect of the present invention provides an accurate volume specimen fit for subsequent qualitative or accurate quantitative analytical testing. Another aspect of the present invention protects the physical integrity of the collected specimen.

BRIEF DESCRIPTION OF THE DRAWINGS

In the drawings,

FIG. 14 illustrates pre specimen collection and FIG. 15 illustrates post specimen collection.

DETAILED DESCRIPTION

Current products that employ fluid collection paper, like those for blood collection, often give analyte concentrations that differ by 20% or more from the true analyte concentration. Without being bound by any one theory, it is believed that the reason for this difference is related to noncompliance during specimen collection and also to the varied and irregularly shaped concentration profiles that occur when fluid is deposited on the collection paper.

Figure 1:
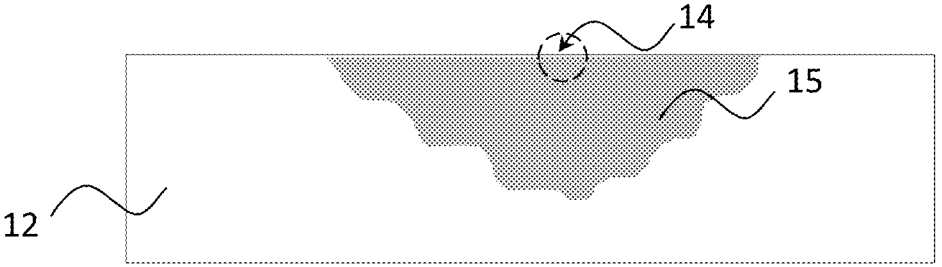
FIGS. 1-4, inclusive, are enlarged sectional elevations of specimen collection paper that illustrate concentration profiles for a single drop of fluid sample applied to the collection paper.
Figure 2:
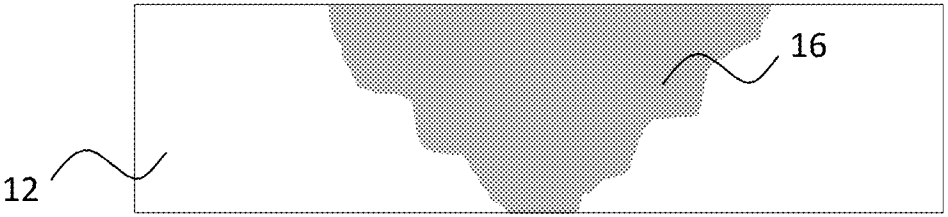
Figure 3:
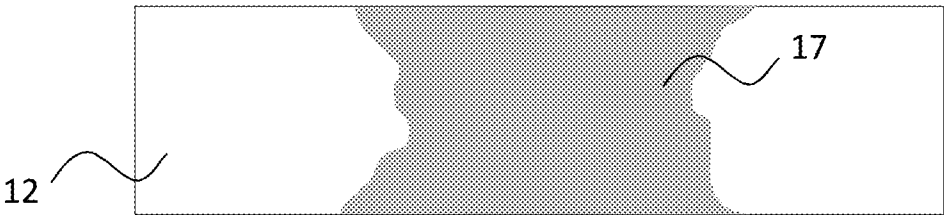
Figure 4:
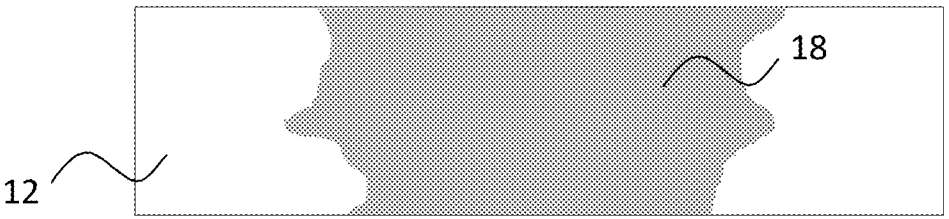

FIGS. 1-5 illustrate some of the ways in which blood concentration profiles can vary when applied to conventional collection paper, thereby illustrating certain deficiencies of conventional sample collection devices. When one drop of blood is applied to the blood collection paper 12 from an initial contact point 14 and the volume of the drop is insufficient to penetrate the reverse side of the blood collection paper, an irregular cone shaped concentration profile 15, as shown in FIG. 1, can be obtained. When the volume of the drop of blood is sufficiently large to penetrate the reverse side of the paper then, depending on the volume of blood in the drop, concentration profiles 16, 17, and 18, shown in FIGS. 2, 3, and 4, respectively, can be obtained.

Figure 5:
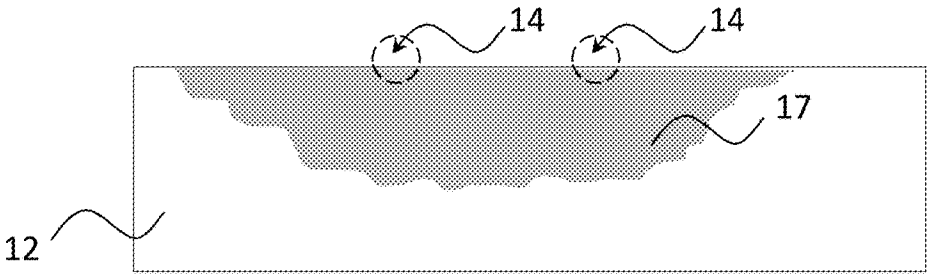
FIG. 5 is an enlarged sectional elevation of specimen collection paper that illustrates a concentration profile when several drops of a fluid sample are applied to the collection paper.

A further deficiency of conventional collection devices may be demonstrated in FIG. 5. When multiple drops of blood are applied, the concentration profile of the blood in the blood collection paper 12 can be even more irregularly shaped, like the concentration profile 19 illustrated from at least two contact points 14 as shown in FIG. 5, because each drop may have a different volume or because the drops may be wholly or partly overlapping.

Contributing to the occurrence of irregularly shaped concentration profiles are any clotting, drying, wicking, chromatographic, elution, or separation phenomena that occur when blood is applied to the paper, particularly when multiple drops of blood are applied or when the blood over-saturates the paper.

One undesirable phenomenon, known as wick-back, occurs when the paper becomes over-saturated and the excess blood leaks through the paper and onto the countertop or other surface upon which the paper rests. When the paper is moved, the fluid transferred to the countertop or other surface becomes reabsorbed into the paper unbeknownst to the user.

Figure 6:
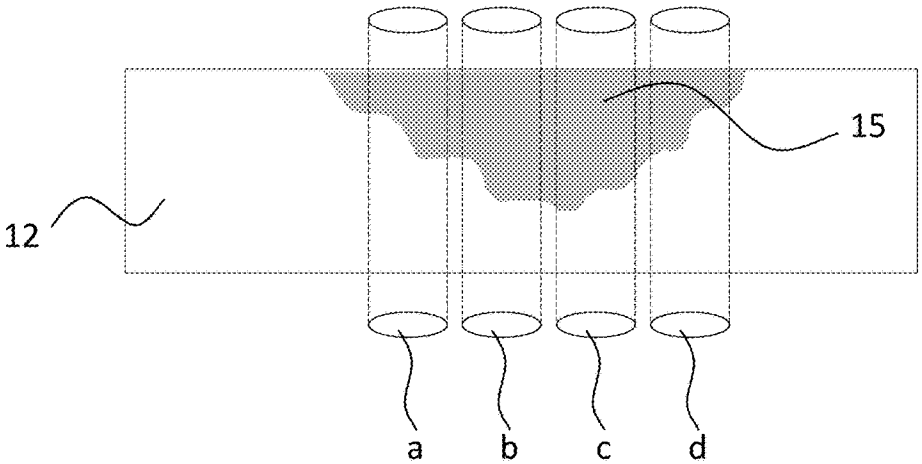
FIG. 6 is a sectional elevation of specimen collection paper showing four separate coupons that can be taken from the concentration profile of FIG. 1, and demonstrating variation in quantity of specimen in the coupon depending on the location from which the coupon was taken.

Typically, a coupon is punched from the blood-containing region of the collection paper, and the analyte of interest is extracted from the coupon and quantitatively determined. Therefore, the presence of an irregularly shaped concentration profile can cause significant error in the determination of the analyte because there is no convenient or cost-effective means of determining whether the coupon that is removed from the blood collection paper for analysis represents the true volume of blood applied to the paper. This potential for error with convention collection devices is illustrated in FIG. 6 for a cone shaped concentration profile 15 (as in FIG. 1) where coupons (a) through (d) cut from different portions of the blood spotted region of the collection paper 12 would each give different analyte measurement results because the actual volume of blood (or blood residue if dried) in each coupon is different.

Figure 7:
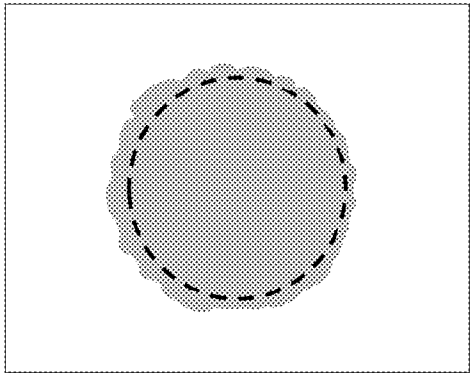
FIG. 7 is an example of a fluid sample collected on a conventional collection card illustrating the effect of the indicia printed directly onto the collection paper.

Additionally, in conventional collection cards, indicia have been printed upon the exposed surface of the card, which indicate where on the card to apply the fluid specimen. The printed indicia may interfere with the uniformity of absorption of the specimen into the paper material. This interference problem associated with certain convention collection devices having printed indicia is illustrated in FIG. 7. The ink or pressure applied during printing process can change the density of the paper material and may cause the specimen to slow or hasten during the spreading processes, either of which will lead to an inconsistent final volume of specimen per coupon.

One embodiment of the present invention comprises an accurate volume fluid collection card system with a single or multiplicity of cells with multiple, preferably three, strata: namely, a middle absorbent stratum layered between an impermeable cover stratum containing at least one aperture and a transparent stratum containing indicia. The inventive composite body fluid sample collection device significantly reduces the difference between the concentration of a body fluid analyte determined from a body fluid sample collected in collection paper and its true analyte concentration.

Referring to the drawings FIGS. 8-23, which illustrate the present invention, a fluid collection card system is shown according to embodiments 10, and 10.1 through 10.6 of the invention. The present invention provides for the collection of an accurate volume of sample.

Figure 8:
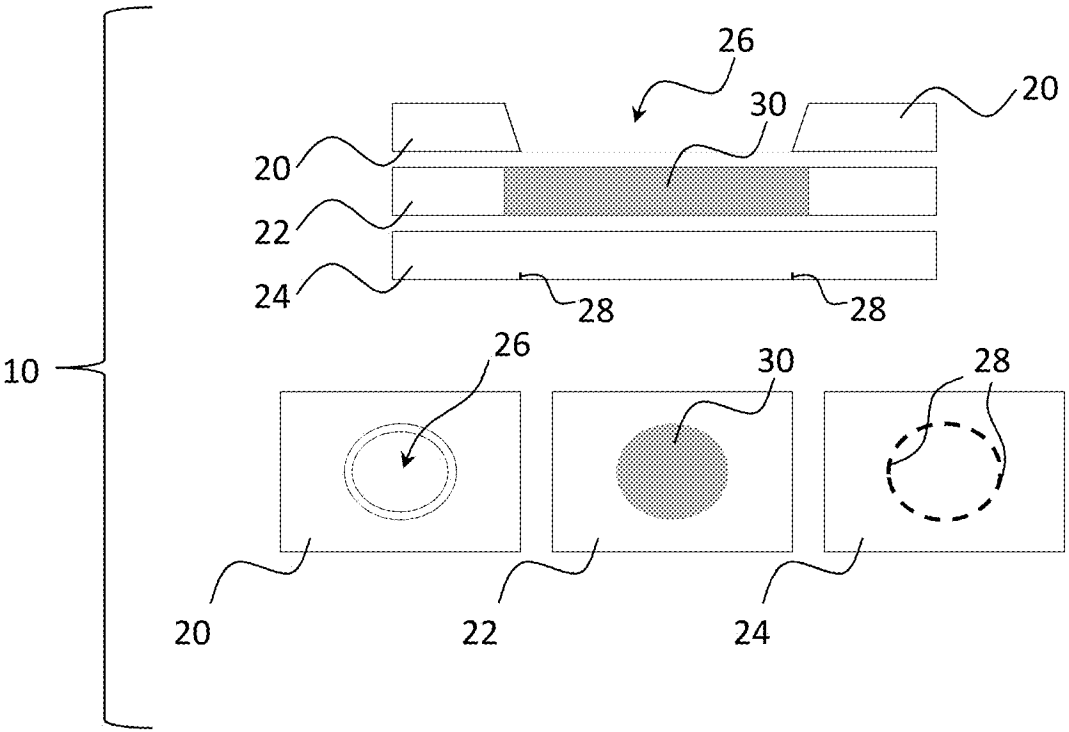
FIGS. 8-12 are sectional elevations of fluid sample collection devices that embody the present invention with a single specimen collection cell.

As illustrated in FIG. 8, a collection card system 10 comprises at least one specimen collection cell 30 preferably with three strata: a middle absorbent stratum 22, layered between an impermeable cover stratum 20 containing at least one aperture 26, preferably with the inner opening being slightly smaller than the outer opening, and a transparent stratum 24 containing indicia 28. The aperture 26 in the impermeable cover stratum directs the fluid onto the middle absorbent stratum 22. The middle absorbent stratum 22 contains no alterations. The transparent stratum 24 contains indicia 28, preferably a single dashed-line circle, which when properly aligned with the aperture and specimen collected; indicate the extent of the absorption of the fluid.

The impermeable cover stratum 20 is composed of materials to suit the requirements of a particular application. For example, the impermeable cover stratum 20 may be formed from a material designed to make the panel either more or less hydrophobic by means of design or subsequent treatment, on one or both surfaces. Alternatively, the impermeable cover stratum 20 may be formed from a material which is of a particular thickness to allow for durability during use and the proper formation of debossments. Additionally, the impermeable cover stratum 20 may be larger or smaller in size than illustrated and may be of any shape, other than the illustrated rectangular shape, to accommodate any number of specimen collection cells. This flexibility in selecting the type of material used allows the accurate volume card system 10 to be used in a variety of applications. Suitable materials are available from CTI Paper USA, 1535 Corporate Center Drive, Suite 400, Sun Prairie, Wis. 53590.

The middle absorbent stratum 22 is composed of materials to suit the requirements of a particular application. For example, the middle absorbent stratum 22 may be formed from a material designed to retain a high sample volume or a lower sample volume. Alternatively, the middle absorbent stratum 22 may be formed from a material which selectively retains components of a sample, or the middle absorbent stratum 22 may be impregnated with a stabilizer, diagnostic reagent, or chemical indicator. Additionally, the middle absorbent stratum 22 may be larger or smaller in size than illustrated and may be of any shape, other than the illustrated rectangular shape, to accommodate any number of specimen collection cells. This flexibility in selecting the type of material used allows the accurate volume card system 10 to be used in a variety of applications. Suitable materials are available from the Whatman International Ltd., of 27 Great West Road, Brentford, Middlesex, United Kingdom TW8 9BW and Ahlstrom North America LLC, 3650 Mansell Road, Suite 250, Alpharetta, Ga. 30022.

The transparent stratum 24 is comprised of materials to suit the requirements of a particular application. For example, the transparent stratum 24 may be formed from a material designed to be completely clear. Alternatively, the transparent stratum 24 may be formed from a material with any degree of opacity, or the transparent stratum 24 may be chemically treated to make the material more or less hydrophobic. Additionally, the transparent stratum 24 may be larger or smaller in size than illustrated and may be of any shape, other than the illustrated rectangular shape, to accommodate any number of specimen collection cells. This flexibility in selecting the type of panel material used allows the accurate volume collection card system 10 to be used in a variety of applications. The chosen material must be capable of holding a printed mark, so that the visual volume indicators may be applied. Suitable materials are available from CTI Paper USA, 1535 Corporate Center Drive, Suite 400, Sun Prairie, Wis. 53590.

Figure 9:
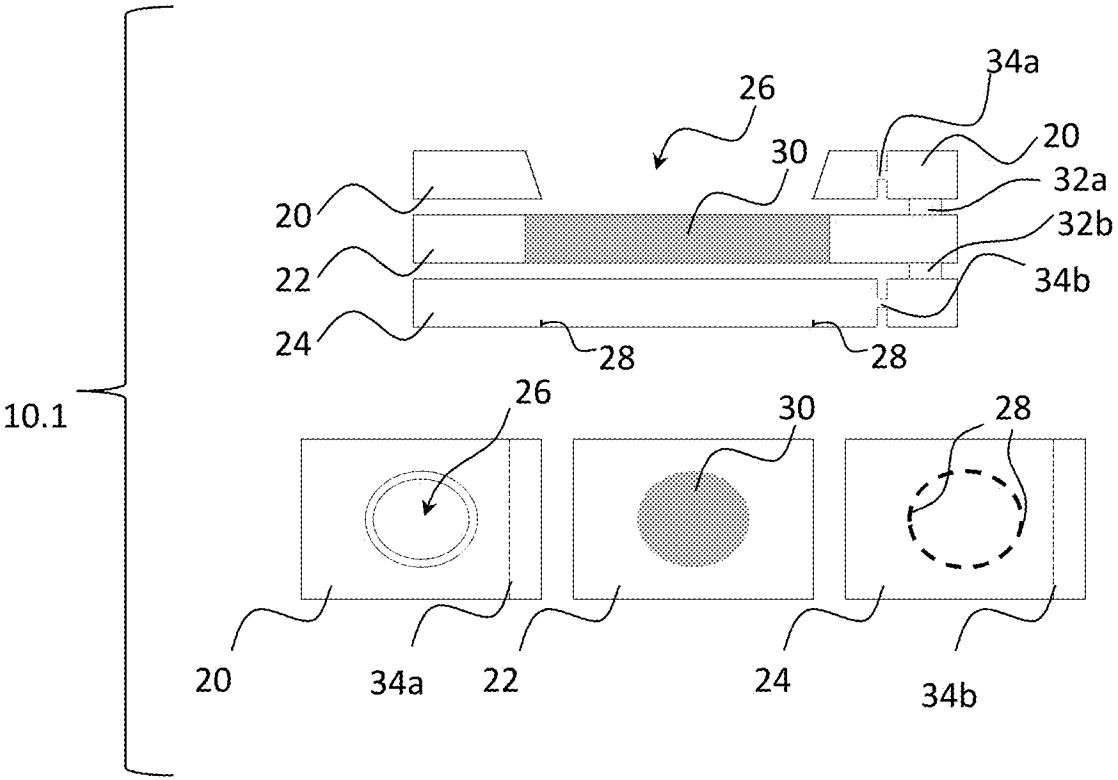

As illustrated in FIG. 9, an additional embodiment of a collection card system 10.1 comprises at least one specimen collection cell 30 preferably with three strata, namely a middle absorbent stratum 22, layered between an impermeable cover stratum 20 containing at least one aperture 26, preferably with an inner opening being smaller than an outer opening, and a transparent stratum 24 containing indicia 28. The aperture 26 in the impermeable cover stratum directs the fluid onto the middle absorbent stratum 22. The middle absorbent stratum 22 preferably contains no alterations. The transparent stratum 24 preferably contains indicia 28, preferably a single dashed-line circle, that when properly aligned with the aperture and specimen collected, indicate the extent of the absorption of the fluid, with the addition of fastener 32*a* between the impermeable cover stratum 20 and the middle absorbent stratum 22, and fastener 32*b* between the middle absorbent stratum 22 and the transparent stratum 24, to ensure the properly aligned with the aperture and specimen collected, and the addition of perforations 34*a* and 34*b* to allow for the removal of portions of the impermeable cover stratum 20 and the transparent stratum 24 to facilitate the collection of specimen coupons.

The fasteners 32*a* and 32*b* are comprised of materials to suit the requirements of a particular application. For example, the fasteners may be formed from an adhesive material designed to be completely clear. Alternatively, the fasteners may be formed from an adhesive material with any degree of opacity, or may be chemically treated to make the material more or less hydrophobic. Additionally, the fasteners may be larger or smaller in size than illustrated and may be of any shape, other than the illustrated rectangular shape, to accommodate any number of specimen collection cells. This flexibility in selecting the type of panel material used allows the accurate volume collection card system 10.1 to be used in a variety of applications. Suitable materials are available from Cyberbond LLC, 401 North Raddant Road, Batavia, Ill. 60510.

Figure 10:
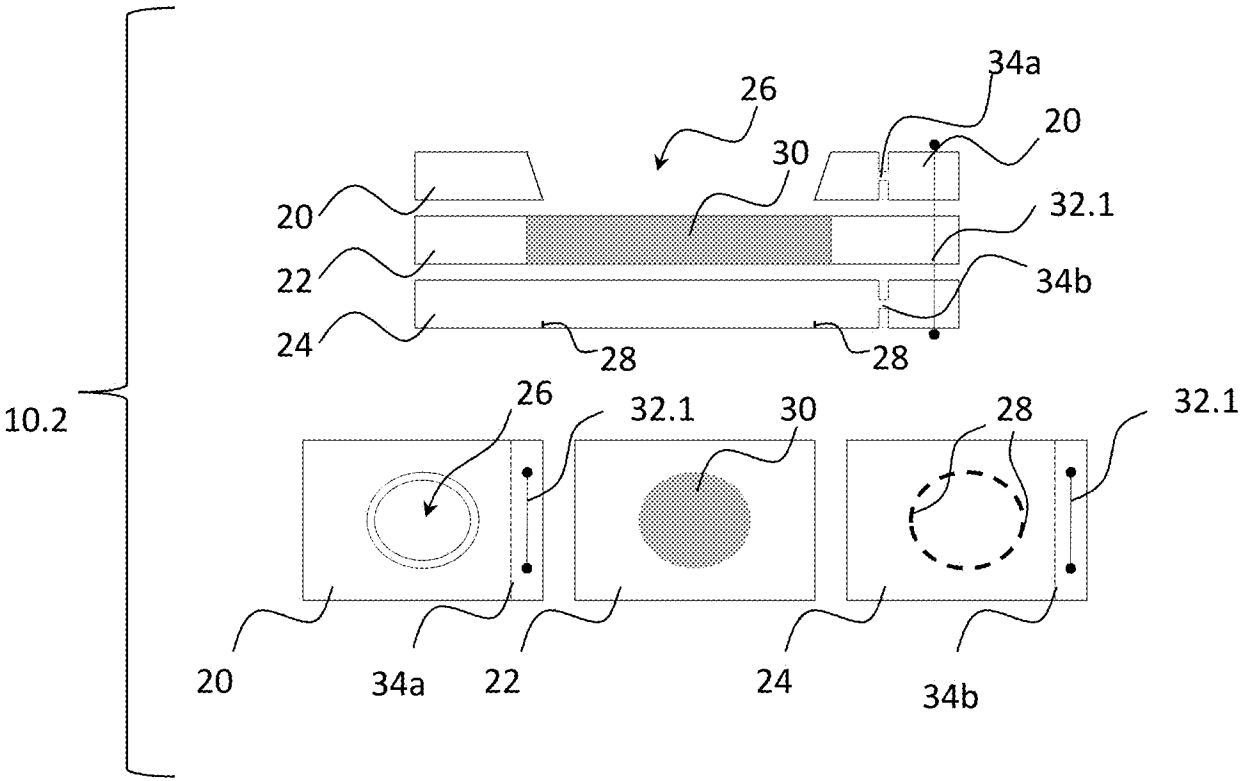

As illustrated in FIG. 10, an additional embodiment of a collection card system 10.2 comprises at least one specimen collection cell 30, preferably with three strata, namely a middle absorbent stratum 22, layered between an impermeable cover stratum 20 containing at least one aperture 26, preferably with an inner opening being smaller than an outer opening, and a transparent stratum 24 preferably containing indicia 28. The aperture 26 in the impermeable cover stratum directs the fluid onto the middle absorbent stratum 22. The middle absorbent stratum 22 preferably contains no alterations. The transparent stratum 24 preferably contains indicia 28, preferably a single dashed-line circle, which when properly aligned with the aperture and specimen collected; indicate the extent of the absorption of the fluid. Fastener 32.1, which penetrates through each of the strata, ensures the properly alignment with the aperture and specimen collected. Additional perforations 34*a* and 34*b* allow for the removal of portions of the impermeable cover stratum 20 and the transparent stratum 24 that may hinder the processing of the collected specimens and facilitate the collection of specimen coupons.

The fastener 32.1 is comprised of materials to suit the requirements of a particular application. For example, the fastener may be formed from a metal material. Alternatively, the fastener may be formed from a plastic material. Additionally, the fastener may be larger or smaller in size than illustrated and may be of any shape, other than the illustrated rectangular shape, to accommodate any number of specimen collection cells. This flexibility in selecting the type of fastener material used allows the accurate volume collection card system 10.2 to be used in a variety of applications. Suitable materials are available from ACME Staple Company, Inc. 87 Hill Road, Franklin, N.H. 03235.

Figure 11:
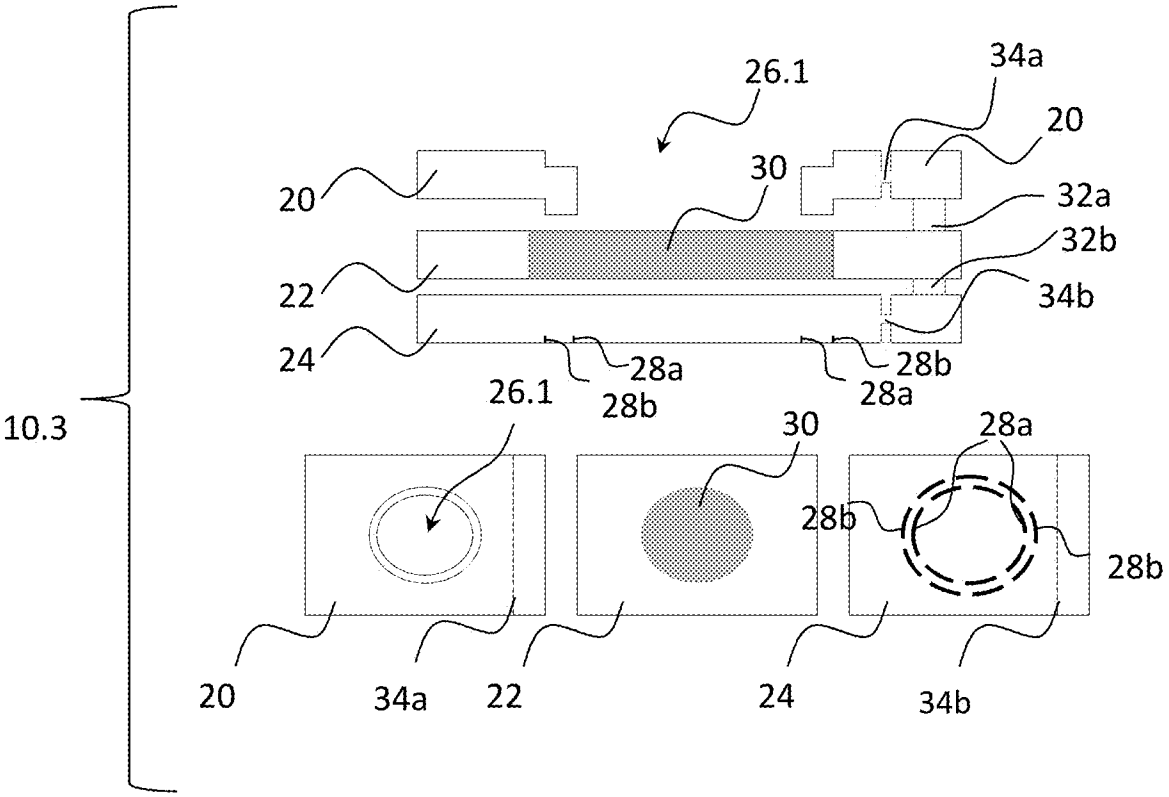

As illustrated in FIG. 11, an additional embodiment of a collection card system 10.3 comprises at least one specimen collection cell 30 preferably with three strata, namely a middle absorbent stratum 22, layered between an impermeable cover stratum 20 containing at least one aperture 26.1, a debossed area, such as a circle, and a transparent stratum 24 preferably containing indicia 28. The aperture 26 in the impermeable cover stratum directs the fluid onto the middle absorbent stratum 22. The middle absorbent stratum 22 preferably contains no alterations. The transparent stratum 24 preferably contains multiple broken-line circles 28*a* and 28*b*, which when properly aligned with the aperture and specimen collected, indicate the extent of the absorption of the fluid. This is one of many possible aperture configurations, which may allow for optimum fluid specimen placement and absorption. The use of multiple indicia may allow for a greater level of detail to direct the user to obtain an accurate volume specimen. For example, the user may be instructed to apply liquid to fill the absorbent material just until between the two broken-line circles.

Figure 12:
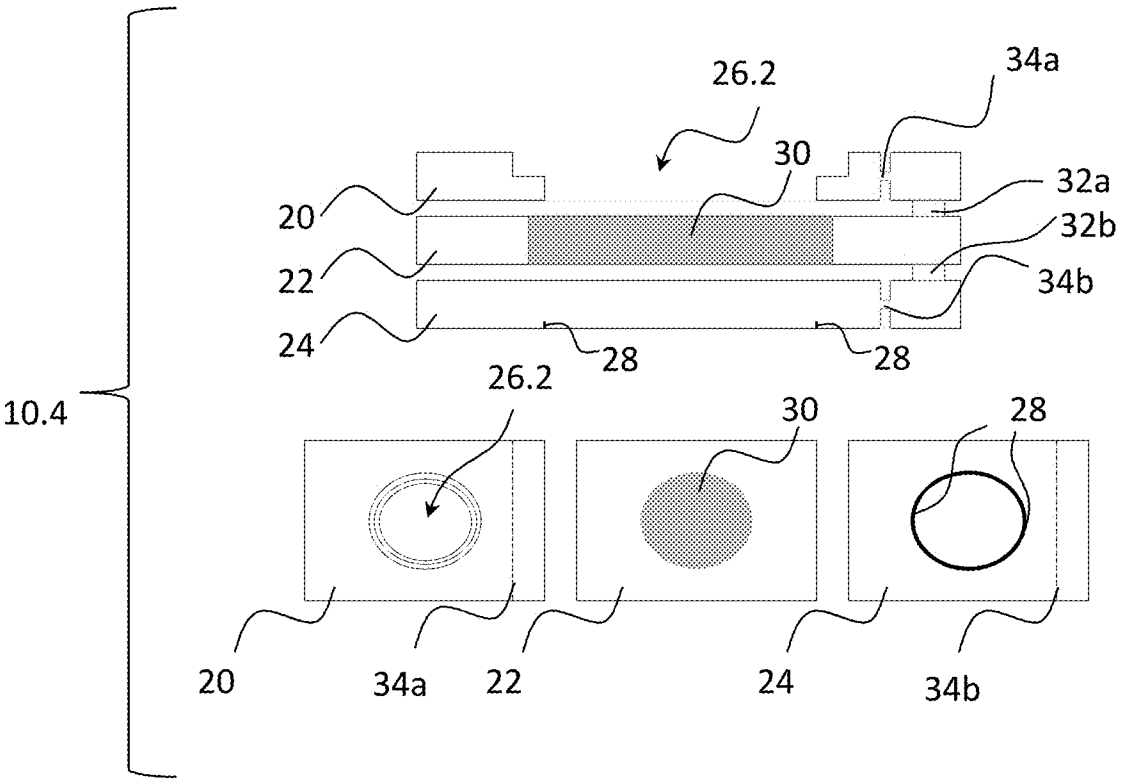

As illustrated in FIG. 12, an additional embodiment of a collection card system 10.4 comprises at least one specimen collection cell 30 preferably with three strata, namely a middle absorbent stratum 22, layered between an impermeable cover stratum 20 containing at least one aperture 26.2, such as a stepped circle, and a transparent stratum 24 preferably containing indicia 28. The aperture 26 in the impermeable cover stratum directs the fluid onto the middle absorbent stratum 22. The middle absorbent stratum 22 preferably contains no alterations. The transparent stratum 24 contains indicia 28, preferably a single dashed-line circle, that when properly aligned with the aperture and specimen collected, indicate the extent of the absorption of the fluid. This is one of many possible aperture configurations, which may allow for optimum fluid specimen placement and absorption.

Figure 13:
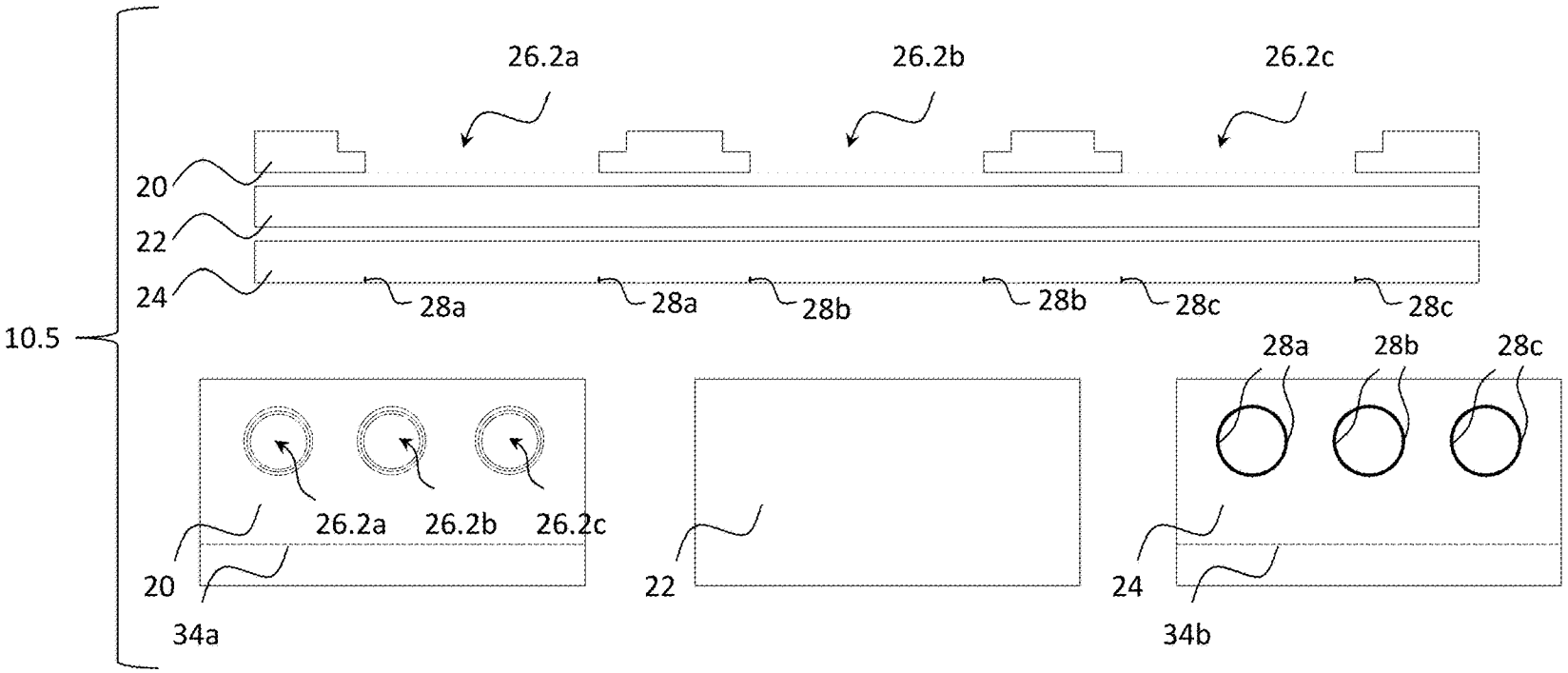
FIG. 13 is a sectional elevation of fluid sample collection devices that embody the present invention with a multiplicity of specimen collection cells.
Figure 14:
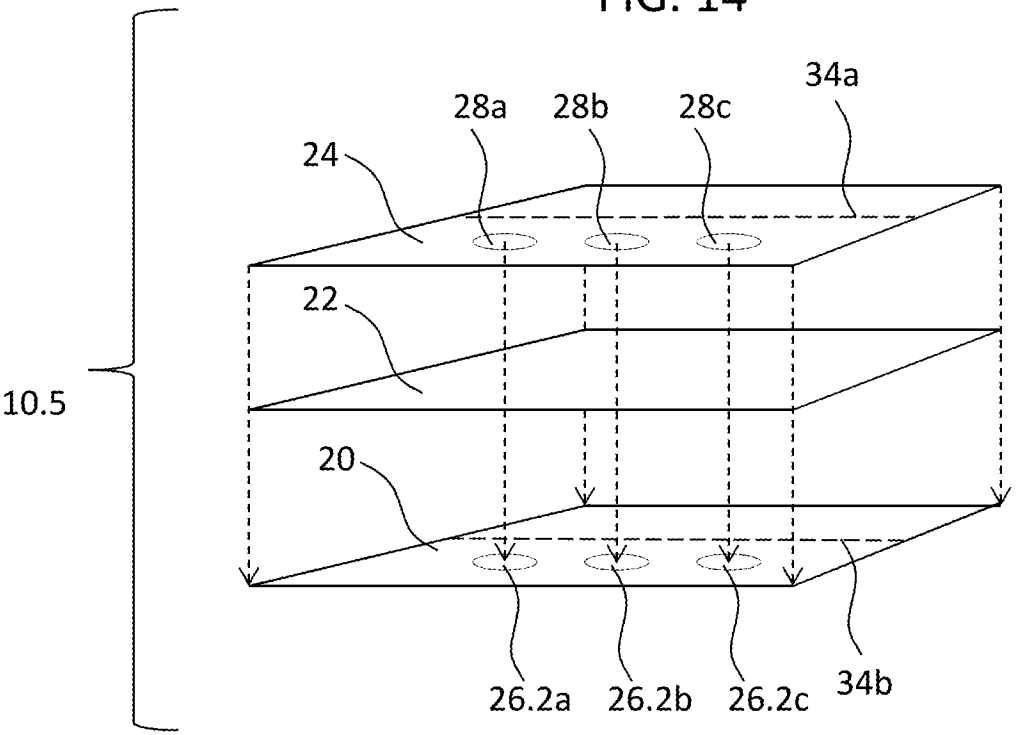
FIGS. 14 and 15 are exploded perspective views of FIG. 13 prior to assembly of components, where
Figure 15:
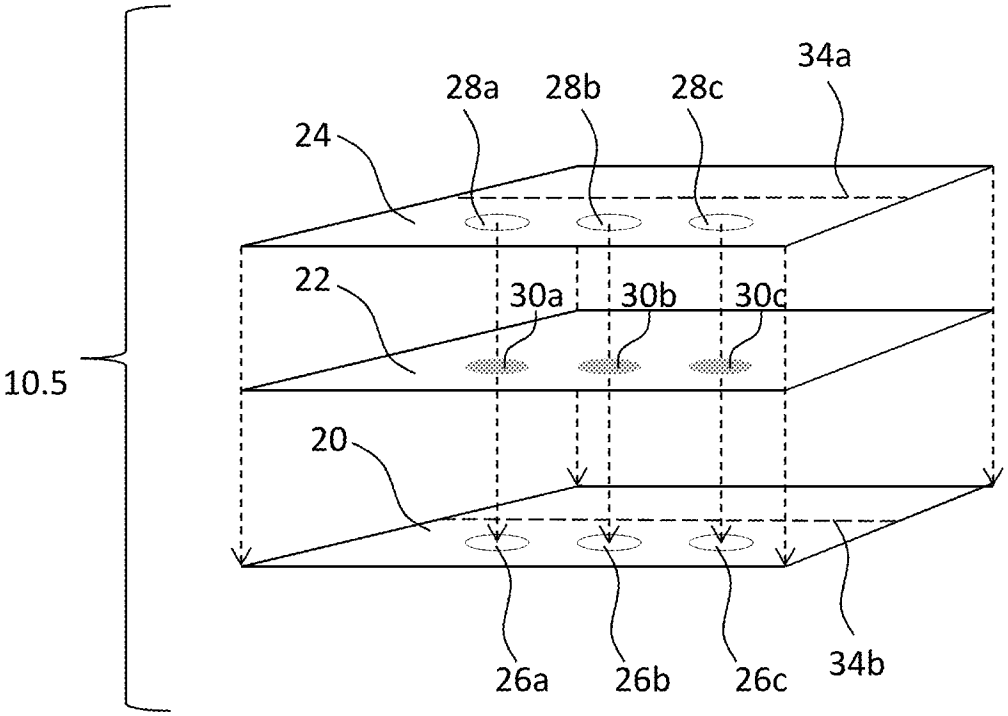

As illustrated in FIGS. 13-15, an additional embodiment of a collection card system 10.5 comprises a multiplicity, such as three, of specimen collection cells 10.4, as described in FIG. 12 preferably with three strata, namely a middle absorbent stratum 22, layered between an impermeable cover stratum 20 containing, for example: three apertures 26*a*, 26*b*, and 26*c*; and a transparent stratum 24 containing, for example: three indicia 28*a*, 28*b*, and 28*c*. The middle absorbent stratum 22 preferably contains no alterations. FIGS. 13 and 14 illustrate embodiment 10.5 with no specimen collected and without fasteners shown. FIG. 15 illustrates embodiment 10.5 with specimens collected. This is one of many possible embodiments, which may allow for multiple fluid specimen collections and placement.

Figure 16:
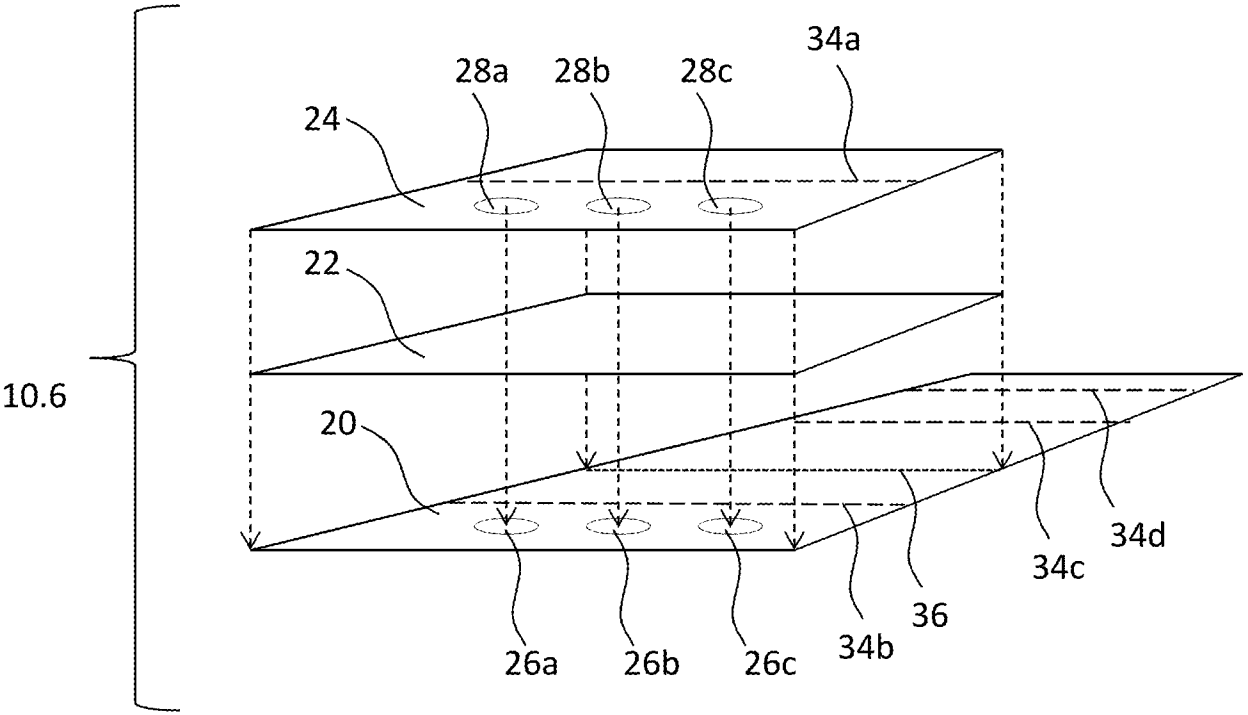
FIG. 16 is an exploded perspective of an additional embodiment, with a multiplicity of specimen collection cells.
Figure 17:
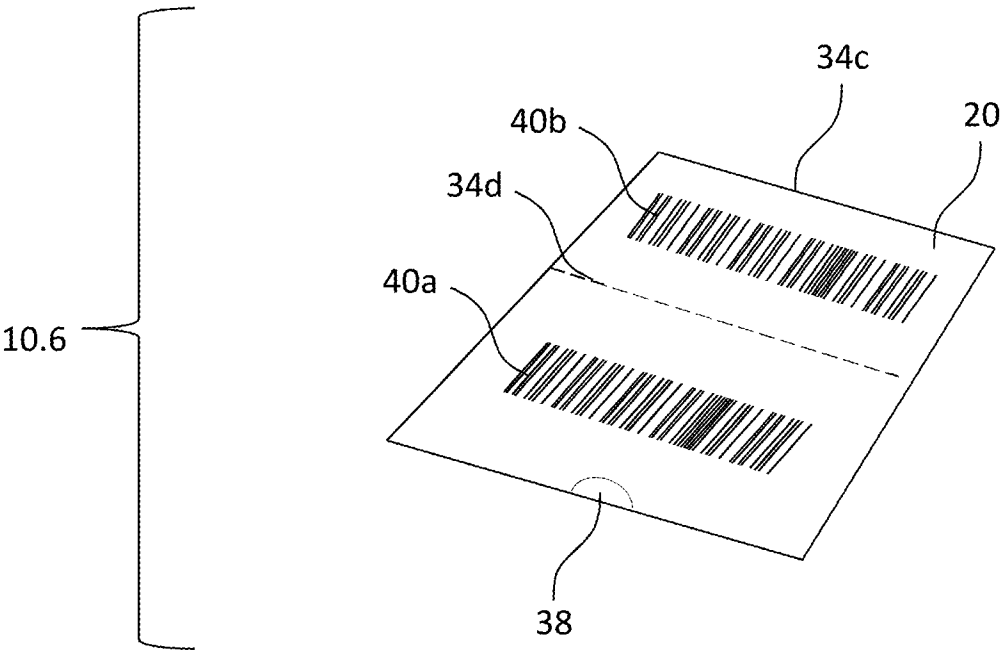
FIG. 17 presents a front perspective view of FIG. 16 following assembly, and prior to use in the initial closed and secured configuration and showing the removable specimen identity information tabs (optional)
Figure 21:
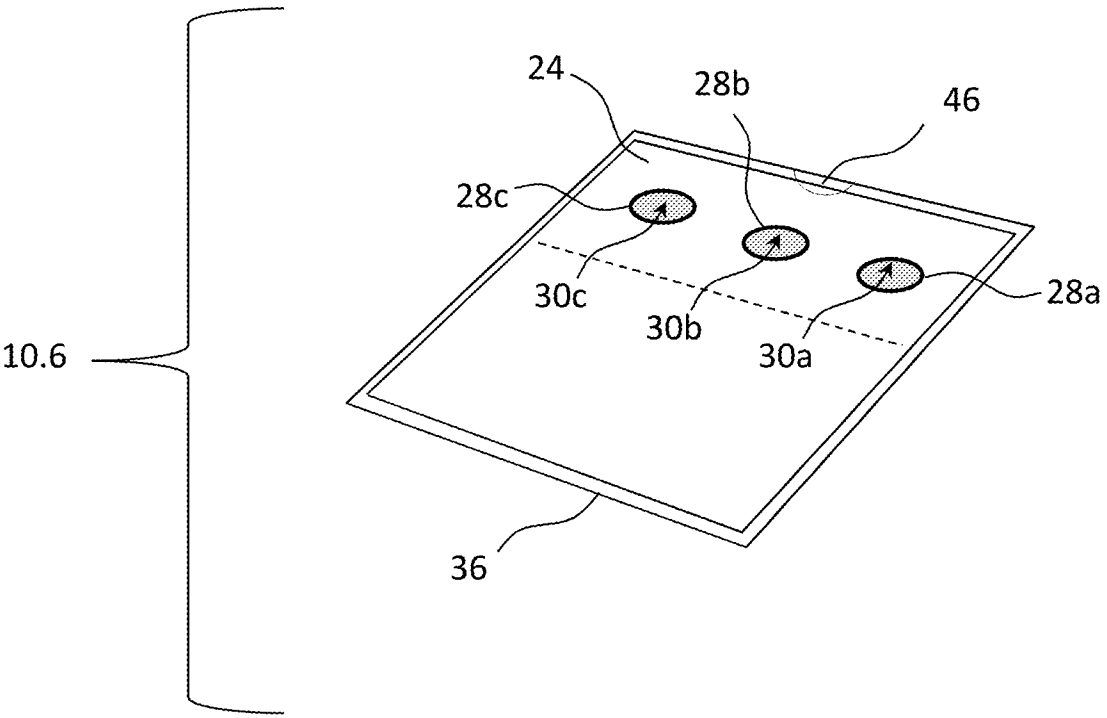
FIG. 21 shows a back perspective view of FIG. 20 following application of the final security seal.

As illustrated in FIG. 16, an additional collection card system embodiment 10.6 comprises a multiplicity, such as three, of specimen collection cells 10.4, as described in FIG. 12 preferably with three strata, namely a middle absorbent stratum 22, layered between an extended impermeable cover stratum 20 containing, for example: three apertures 26*a*, 26*b*, and 26*c*, three perforations 34*b*, 34*c*, and 34*d*, and one fold 36; and a transparent stratum 24 containing: three indicia 28*a*, 28*b*, and 28*c*. The middle absorbent stratum 22 preferably contains no alterations. The collection card system embodiment 10.6 preferably is attached along or near the fold 36 by an adhesive or mechanical fastener (not shown), and adhesive seals (not shown), and is movable between an initial closed and secured configuration, to an open configuration for specimen collection, back to a closed configuration for transportation to the analytical laboratory, and then open for specimen sampling and analysis. FIG. 16 shows the collection card system embodiment 10.6 prior to assembly; FIG. 17 shows the collection card system 10.6 in the initial closed and secured configuration, and FIG. 21 shows the collection card system 10.6 in the final closed and secured configuration.

FIGS. 18, 19, 20, 22, and 23 show the collection card system 10.6 in an open configuration.

Referring back to FIG. 16, one preference for the collection card system 10.6 provides apertures 26*a*, 26*b*, and 26*c* in the impermeable stratum 20 as debossed to create a funneling effect when specimens are applied, and are generally the same size and shape as the indicia 28*a*, 28*b*, and 28*c* on the transparent stratum 24 and located directly opposite of 26*a*, 26*b*, and 26*c*, respectively. Perforations 34*b*, 34*c* and 34*d* are present on the impermeable stratum 20 and perforation 34*a* is present on the transparent stratum 24, to allow for the removal of the portions of the strata that cover the specimens collected, to allow for ease of collection of specimen coupons for subsequent analysis. Preferably, the impermeable stratum 20 is of sufficient length to fold twice at fold line 36 and perforated fold line 34*c* such that it covers the exposed surfaces of the middle absorbent stratum 22 when closed.

As shown in FIG. 17, when the collection card system 10.6 is in the initial closed configuration, preferably the system is secured by the initial security seal 38. As such, the absorbent stratum 22 (not shown) is protected from unintentional environmental contamination, or other types of contamination, including, for example, intentional contamination, by the impermeable stratum 20. Optional specimen identification labels 40*a* and 40*b* are visible and may be divided and removable by the perforations 34*c* and 34*d*. These aspects are typically required for specimens requiring strict chain of custody, for example in cases of workplace testing.

An initial security seal 38 is comprised of materials and of a particular size and shape to suit the requirements of a particular application. For example, the seal 38 may be formed from a material designed to indicate tampering. Alternatively, the seal 38 may be formed from a material which is easily removed, or the seal 38 may be made of reusable material. Additionally, the seal 38 may be larger or smaller in size than those illustrated and may be of any shape, other than the illustrated circle shape. The use of additional or fewer seals is also optional. This flexibility in selecting the type of seal material used allows the accurate volume card system 10.6 to be used in a variety of applications. Suitable materials are available from Label Systems, Inc., 4111 Lindbergh Dr. Addison, Tex. 75001.

Figure 18:
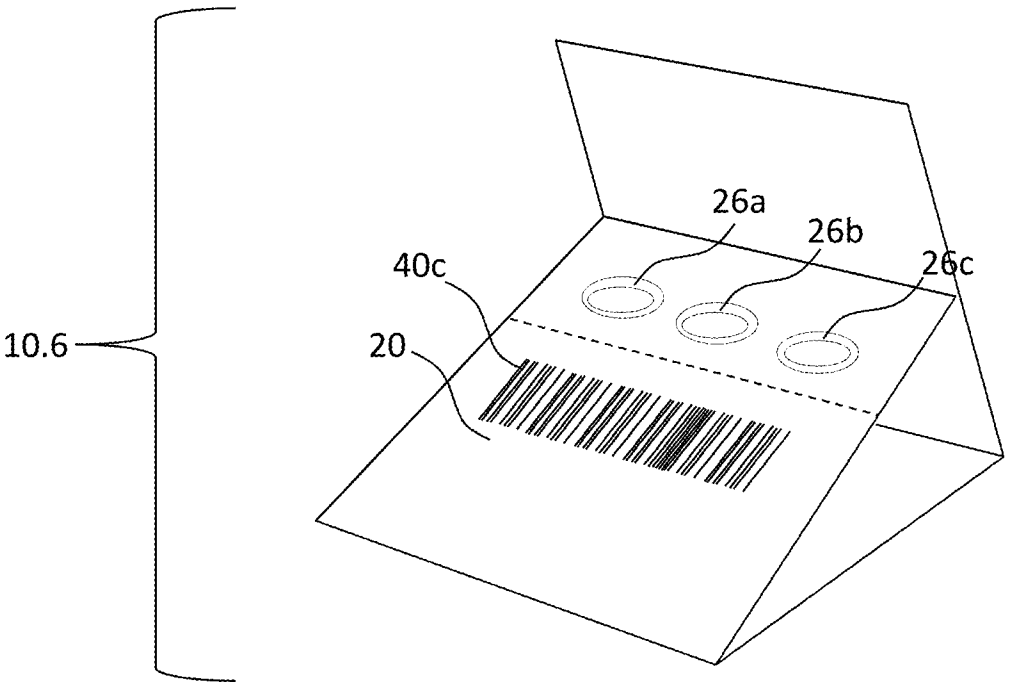
FIG. 18 shows a front perspective view of FIG. 17 following the breaking of the initial security seal, but prior to specimen collection and removal of the specimen identity information tabs (optional).

As illustrated in FIG. 18, when the collection card system 10.6 is in an open configuration, the absorbent stratum 22 (not shown) is accessible via the apertures 26*a*, 26*b*, and 26*c* in the impermeable stratum 20, limiting the collection of specimens to the locations being accessed by the indicia 28*a*, 28*b*, and 28*c* located on the transparent stratum 24 (not shown). In this example, one, two, or three specimens may be collected from the test subject. Most preferably, specimen identity 40*c* is also located on the impermeable stratum 20 so that the specimen identity remains with the specimen(s) at all times.

Figure 19:
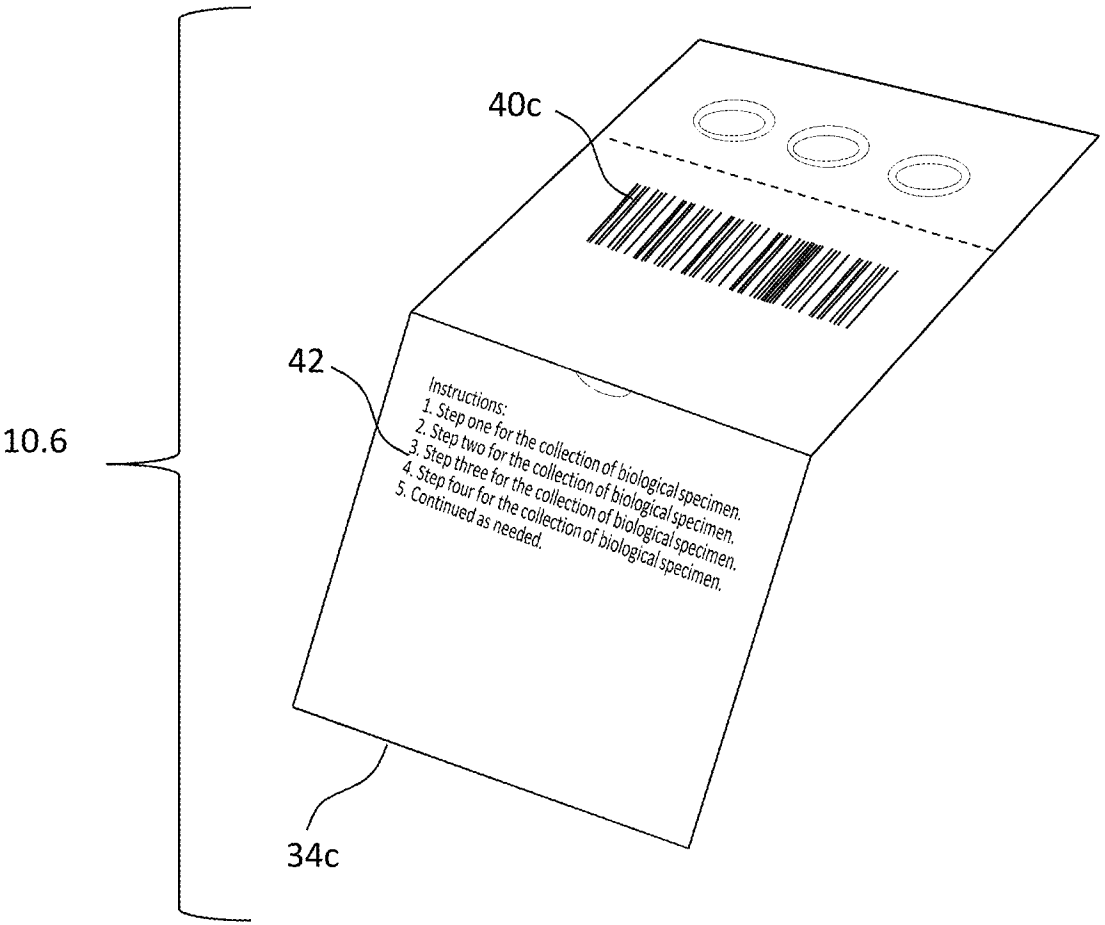
FIG. 19 shows a front perspective view of FIG. 18 following the removal of the specimen identity formation tabs (optional).

As shown in FIG. 19, when the collection card system 10.6 is in an alternative open configuration, the specimen identity information 40*a* and 40*b* (not shown) have been removed along perforation 34*c*. This allows for ease of communication of specimen identity, for example to the patient or physician. In addition, in the alternative open position, the collection card system embodiment 10.6 may be opened to show preferable optional user instructions 42 for increasing compliance with specimen collection.

Figure 20:
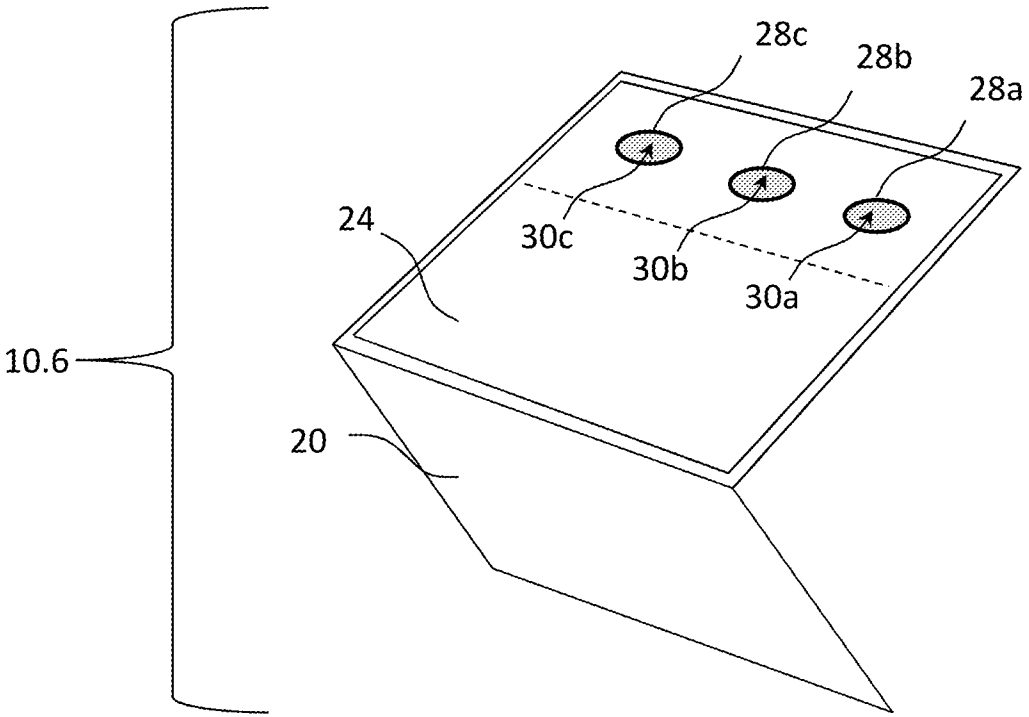
FIG. 20 presents a back perspective view of FIG. 19 showing the transparent panel following specimen collection.

As shown in FIG. 20, the collection card system embodiment 10.6 is in yet another alternative open configuration. The collected specimens 30*a*, 30*b*, and 30*c* are viewable through the opacity of the transparent stratum 24 attached to the impermeable stratum 20, which allows the user to assess visually via the indicia 28*a*, 28*b*, and 28*c*. If a complete specimen volume has been applied, the indicia 28*a*, 28*b*, and 28*c* will be adequately filled. This allows the user to assess the quality of the specimen collected and allows for the immediate collection of additional specimen(s) if required.

As shown in FIG. 21, the collection card system embodiment 10.6 is in an alternative closed configuration, the absorbent stratum 22 (not shown) and the collected specimens 30*a*, 30*b*, 30*c* are secured by final security seal 46, between the transparent stratum 24, which contains indicia 28*a*, 28*b*, 28*c* and the impermeable stratum 20 (not shown). When stored, for example with an appropriate desiccant (not shown), this configuration allows for the specimen to continue to dry during transport for analysis.

Figure 22:
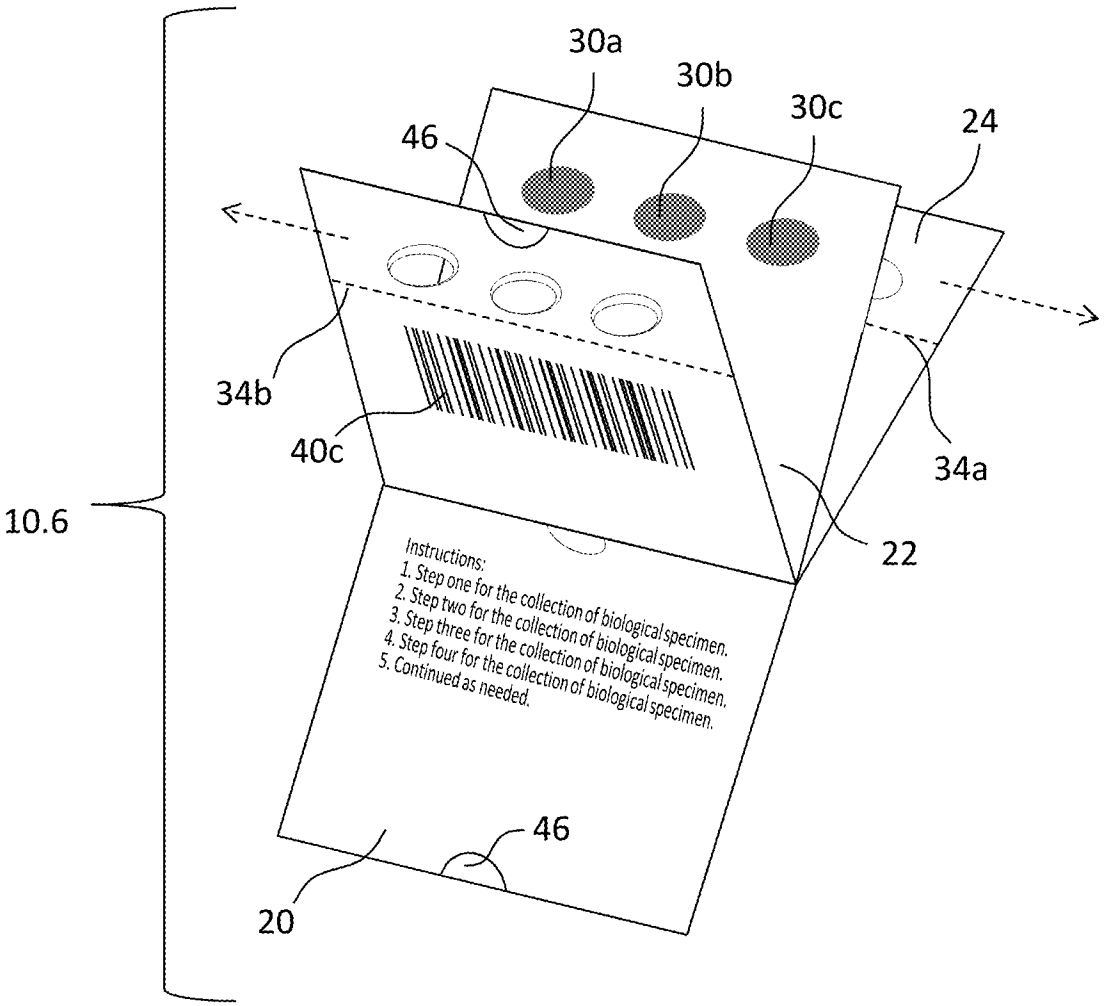
FIG. 22 presents a front perspective view of FIG. 21 following breaking of the final security seal, but prior to removal of the funneling cover tab and visual volume indicator tab to allow for sampling of specimen(s) for analysis.
Figure 23:
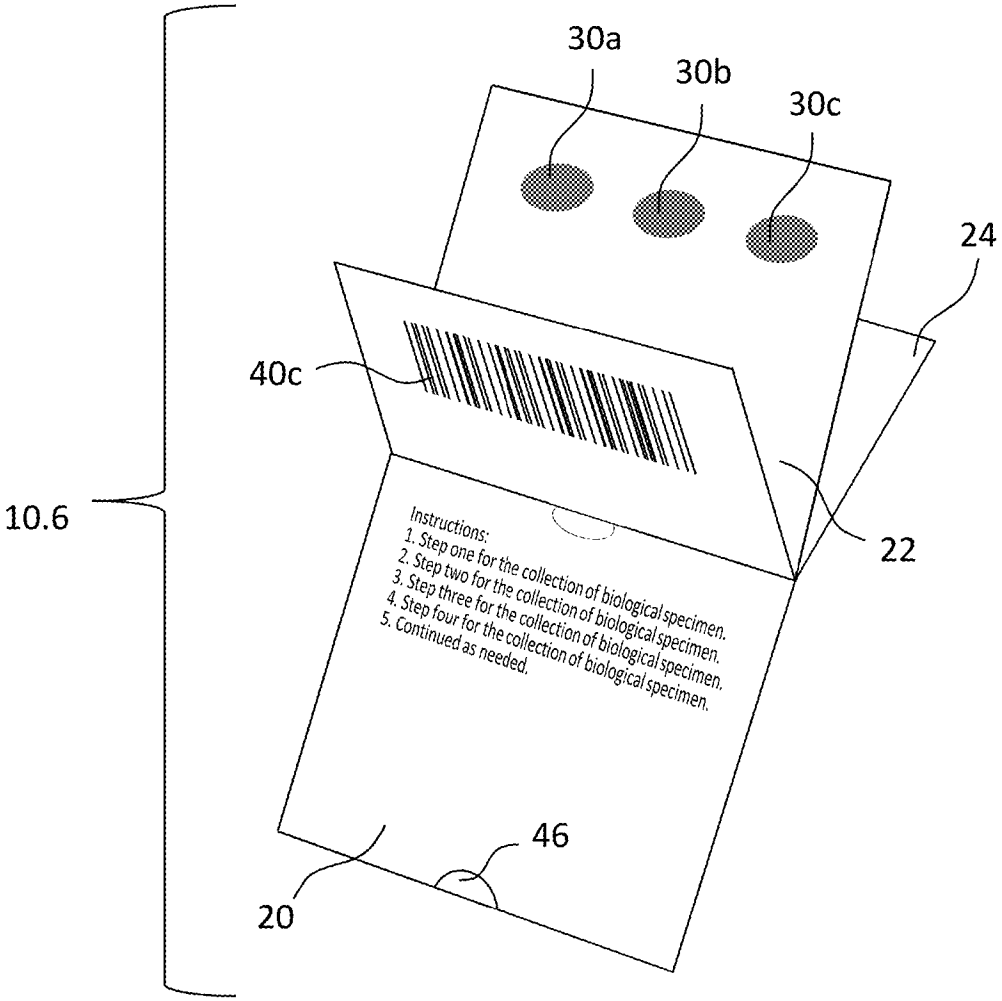
FIG. 23 presents a front perspective view of FIG. 22 following removal of the funneling cover tab and visual indicator tab to allow for ease of sampling of specimen(s) for analysis, including automated sampling.

As presented in FIGS. 22 and 23, the collection card system embodiment 10.6 is in yet another alternative open configuration, with the final security seal 46 having been broken to allow for the creation of specimen coupons (not shown) from the collected specimens 30*a*, 30*b*, 30*c* to allow for subsequent analysis. The absorbent stratum 22 is accessible between the transparent stratum 24 and the impermeable stratum 20. To facilitate creation of specimen coupons, a portion of the impermeable stratum 20 and a portion of the transparent stratum 24 may be removed at the perforations 34*b* and 34*a*, respectively. Preferably, the specimen identification information 40*c* is placed so that it is not removed and stays with the remaining specimens following coupon creation.

The use of the present invention, which provides an accurate volume collection card system, is not limited only to "quantitative" analysis of specimens collected, but would include any subsequent analysis for which a clean non-contaminated specimen was required, for example qualitative analysis of endogenous or exogenous compounds or substances.

Persons skilled in the art of biological specimen collection will understand that many of the details provided herein are by way of example only and are not intended to limit the scope of the invention, which is to be determined with reference to the following claims.

What is claimed is:

1. A collection card system comprising:

a) a cover, wherein said cover has at least one debossed funneling aperture having an inner opening slightly smaller than the outer opening that directs a sample having a measurable volume onto b);

b) an unaltered absorbent material layered beneath said cover; and c) a base layered beneath the entirety of the absorbent material, which is impermeable to the sample but permits drying.

2. The collection card system of claim 1, wherein the cover is comprised of impermeable material.

3. The collection card system of claim 1, wherein the cover has three apertures.

4. The collection card system of claim 1, wherein the base is transparent.

5. The collection card system of claim 1, wherein the base contains indicia corresponding to and aligned with the one or more aperture.

6. A method of collecting a sample for analyte evaluation comprising:

a) collecting one or more sample specimen on a device comprising:

i) a cover, wherein said cover has at least one debossed funneling aperture having an inner opening slightly smaller than the outer opening that directs the sample having a measurable volume onto b);

ii) an unaltered absorbent material layered beneath said cover; and iii) a base layered beneath the entirety of said absorbent material, which is impermeable to the sample but permits drying.

7. The method of claim 6, wherein the cover is comprised of impermeable material.

8. The method of claim 6, wherein the cover has three apertures.

9. The method of claim 6, wherein the base is transparent.

10. The method of claim 6, wherein the base contains indicia corresponding to and aligned with the one or more aperture.

11. A device for collection of a bodily fluid sample having a measurable volume comprising at least three strata, wherein a first stratum provides one or more debossed funneling apertures having inner openings slightly smaller than the outer openings that direct for deposition of the sample and; a second stratum layered beneath the first stratum, the second stratum comprised of an unaltered absorbent material to collect the sample; and a third stratum layered beneath the entirety of the second stratum, the third stratum allowing for indication of volume of sample, which is impermeable to the sample but permits drying.

12. A card for the collection of a bodily fluid sample having a measurable volume comprising at least three strata, wherein a first stratum provides one or more debossed funneling apertures having inner openings slightly smaller than the outer openings that direct deposition of the sample; a second stratum layered beneath the first stratum, the second stratum comprised of an unaltered absorbent material to collect the sample; and a third stratum layered beneath the entirety of the second stratum, the third stratum allowing for indication of volume of sample, which is impermeable to the sample but permits drying; wherein the card comprises an indicator for assessing the volume of the sample, wherein the indicator does not impede the collection or analysis of the sample.

13. A system for sample collection of a sample having measurable volume comprising:

a) a first layer of impermeable material, wherein the first layer provides one or more debossed funneling apertures having inner openings slightly smaller than the outer openings that direct for deposition of the sample;

b) a second layer of unaltered absorbent material, wherein the second layer provides for collection of the sample; and c) a third layer of transparent material layered beneath the entirety of the second layer, which is impermeable to the sample but permits drying, wherein the third layer provides for assessing an adequate amount of sample absorbed on the second layer.

14. A device for the collection of a sample comprising one or more debossed funneling apertures having an inner opening slightly smaller than the outer opening that directs deposition of sample having a measurable volume; an unaltered substrate for maintaining the sample; a visual indicator for assessing the volume of the sample; and a transparent layer beneath the entirety of the substrate, which is impermeable to the sample but permits drying.

* * * * *